US005957610A

United States Patent [19]

Yamanaka

[11] Patent Number: 5,957,610

[45] Date of Patent: Sep. 28, 1999

[54] PENPOINT

[76] Inventor: Shizuo Yamanaka, 4-15-33-706, Shimo-renjaku, Mitaka-shi, Tokyo, Japan, 181

[21] Appl. No.: 08/758,810

[22] Filed: Dec. 4, 1996

[30] Foreign Application Priority Data

Dec. 5, 1995 [JP] Japan ..... 7-316668

[51] Int. Cl.[6] ..... B43K 1/02; B43K 1/06

[52] U.S. Cl. ..... 401/221; 401/224; 401/231; 401/235; 401/265; 401/292

[58] Field of Search ..... 401/221, 222, 401/265, 292, 233, 257, 231, 235, 224

[56] References Cited

U.S. PATENT DOCUMENTS

| | | | |
|---|---|---|---|
| 824,790 | 7/1906 | Jameson | 401/233 |
| 1,878,879 | 9/1932 | Mon | 401/269 |
| 3,518,019 | 6/1970 | Nakamura | 401/265 |
| 4,531,853 | 7/1985 | Hirabayashi et al. | 401/265 |

FOREIGN PATENT DOCUMENTS

| | | | |
|---|---|---|---|
| 90 | of 1874 | United Kingdom | 401/292 |
| 8748 | of 1893 | United Kingdom | 401/221 |

*Primary Examiner*—Steven A. Bratlie
*Attorney, Agent, or Firm*—Browdy and Neimark

[57] ABSTRACT

A penpoint has a base portion and a plurality of comb-tooth pieces and a converging member fitted over the portion of the penpoint body between the base portion and the comb-tooth pieces. The uniform pressure of the converging member converges the comb-tooth pieces front ends into an undistorted hemispheric writing portion having ink passages between the adjoining comb-tooth pieces. When the penpoint is pressed against paper with the pen axis inclined, the front ends of the comb-tooth pieces shift and elastically deform to expand the outer diameter of the hemispheric portion. When pressure is relieved it returns to its original hemispherical shape. The thickness of strokes varies according to writing pressure. The penpoint can write in any direction.

20 Claims, 7 Drawing Sheets

PENPOINT

BACKGROUND OF THE INVENTION

1. Field of the Invention

The present invention relates to a penpoint or nib used on fountain pens and other writing materials and more particularly to a penpoint, which can write on paper in any direction and, after the penpoint is rotated about a pen axis, can also write at any rotated position and at any angle with respect to the paper, and which has a writing brush function whereby it offers a soft touch when placed in contact with paper and, according to the writing pressure, changes the width of strokes to produce thick or fine lines thus realizing a variety of modes of handwriting.

2. Prior Art

To eliminate a disadvantage of conventional fountain pens and other writing instruments with a single penpoint that they can only write in a certain direction, a polygonal penpoint assembly has come to be used in recent years, which consists of three penpoint pieces combined together, each having a similar shape to the conventional single penpoint. This polygonal penpoint assembly has three penpoint pieces combined back to back. It has three blades formed convex in three circumferential directions around the center axis of the pen and V-shaped recessed surfaces between the blades, with a hemispheric writing tip formed at each front end of the blades. Because of the hemispheric writing tip, the polygonal penpoint assembly can write on paper in any direction and, after the penpoint is rotated about a pen axis, can also write at any rotated position and at any angle with respect to the paper.

Some polygonal penpoint assemblies are made of molded resin and have their writing tip ground, rounded or cut to suit their needs. There are so-called plastic pens that use a bar-like core extrusion-molded of polyacetal resin and having continuous guide holes. So-called plastic fountain pens have a plate-like pen body with a porous guide hole formed at the center thereof. So-called marker pens have polyester fibers bound together with resin and formed into a bar-like core while maintaining porosity. These pens utilize flexibility and self-lubrication ability of the resin materials and have simple constructions and therefore high productivity.

To enable the pen to write on paper in any direction and, after the penpoint is rotated about a pen axis, to also write at any rotated position and at any angle with respect to the paper, however, the conventional polygonal penpoint assembly structure has a drawback that when a writing pressure is applied to the penpoint, the tips of the penpoint pieces do not move or shift relative to each other, with the hemisphere portions at the tips remaining almost unchanged, so that it feels like a hard pen such as a ball-pointed pen.

As for the conventional resin-molded penpoints, there are the following problems. Because of the softness of the resin materials, the resin-molded penpoints cannot withstand a long period of use and easily deform under the writing pressure, resulting in significant wear. Further, although the resin materials have resiliency, the degree of resilience is not enough to cause such large deflections to the penpoint as will deform the writing tips and change the width of strokes. Thus, the characters can only be written with strokes of a fixed width.

SUMMARY OF THE INVENTION

The object of this invention is to overcome these drawbacks of the conventional penpoints and to provide a novel penpoint, which can write on paper in any direction and, after the penpoint is rotated about a pen axis, can also write at any rotated position and at any angle with respect to the paper; which can offer soft resilient touches and, according to the writing pressure, change the width of strokes to produce thick or fine lines thus realizing a variety of modes of handwriting; and which can withstand a long period of writing and alleviate changes in the original shape and wear.

To achieve the above objective, the penpoint of the present invention comprises: a penpoint body having a cylindrical base portion and a plurality of comb-tooth pieces merging with one end of the base portion, the comb-tooth pieces each axially projecting, having an arc lateral cross section, and arranged at equal intervals along a circumference about an axis of the penpoint body to form slit-like grooves between the comb-tooth pieces, the comb-tooth pieces also having divided hemisphere portions at the front ends thereof which, when bound together, form into a hemisphere shape; and a converging member formed as a cylinder and fitted over an outer circumference of the penpoint body to press the plurality of the comb-tooth pieces to converge toward the axis of the penpoint body; wherein the converging member is fitted over the penpoint body to force the plurality of the comb-tooth pieces of the penpoint body to converge into a conical shape whose diameter progressively decreases toward the front end, and in this bound state of the comb-tooth pieces a hemispheric writing portion is formed at the front ends of the comb-tooth pieces and ink introducing passages are formed between the comb-tooth pieces.

The penpoint of this invention therefore has the cylindrical converging member that is fitted over the outer circumference of the penpoint body to force a plurality of the comb-tooth pieces to converge toward the axis of the penpoint. When fitted over the penpoint body, the converging member binds together the comb-tooth pieces of the penpoint body into a conical shape whose diameter progressively decreases toward the front end, thus forming the hemispheric writing portion at the front end, with the ink introducing passages formed between the comb-tooth pieces. Because the comb-tooth pieces are in elastic contact with each other, when the hemispheric writing portion formed at the front ends of the comb-tooth pieces is pressed against the paper with the pen axis inclined, the divided hemisphere portions of the comb-tooth pieces shift relative to each other and elastically deform to expand the outer diameter of the front end writing portion. When the penpoint is relieved of the writing pressure, the front end writing portion recovers the original hemispheric shape by elasticity.

With this invention, therefore, the penpoint body comprises a base portion and a plurality of comb-tooth pieces and is assembled into a simple structure in which a converging member is fitted over the portion of the penpoint body between the base portion and the comb-tooth pieces. The uniform pressure of the converging member forces the comb-tooth pieces to converge into an undistorted cone, with the front ends of these comb-tooth pieces bound together to form an undistorted hemispheric writing portion and with ink introducing passages formed between the adjoining comb-tooth pieces. When the hemispheric writing portion of this penpoint is pressed against paper with the pen axis inclined, the divided hemisphere portions at the front ends of the comb-tooth pieces shift relative to one another and elastically deform to expand the outer diameter of the hemispheric portion. When the penpoint is relieved of the writing pressure, the front end writing portion returns to its original hemisphere shape. Hence, the penpoint can write on paper in any direction and, after the penpoint is rotated about a pen axis, can also write at any rotated position and at any angle with respect to the paper. The penpoint offers the writer a soft writing touch and allows him or her to change the thickness of strokes according to the writing pressure applied, realizing a variety of modes of handwriting. Further, this penpoint can withstand a long period of writing and minimize changes in original shape and wear.

BRIEF DESCRIPTION OF THE ATTACHED DRAWINGS

Figure 4:
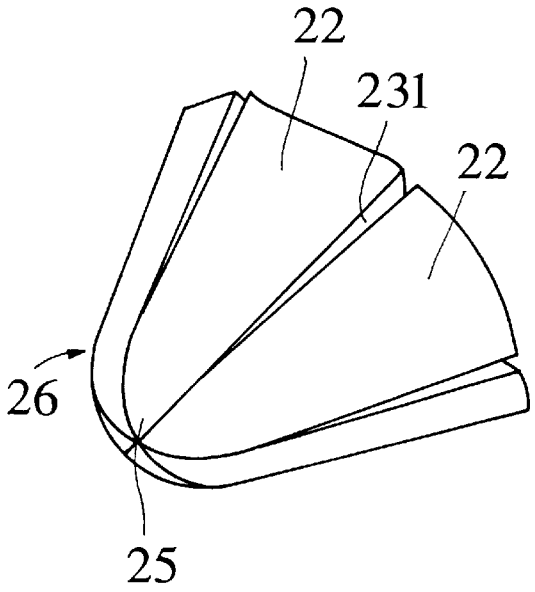
Figure 5:
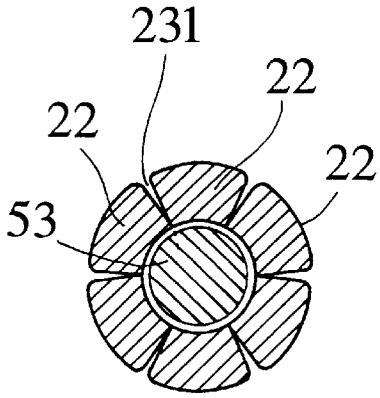
Figure 6:
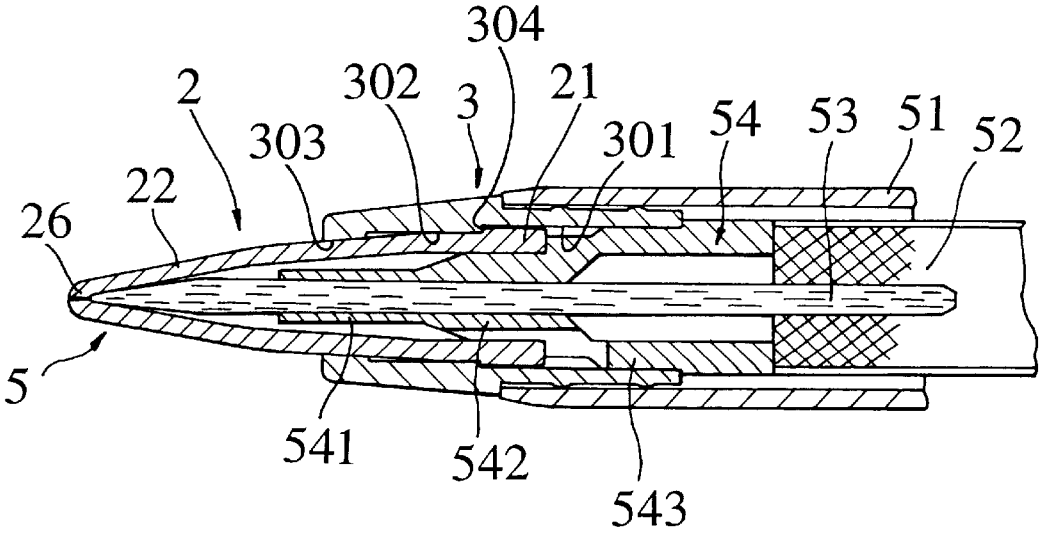
Figure 7:
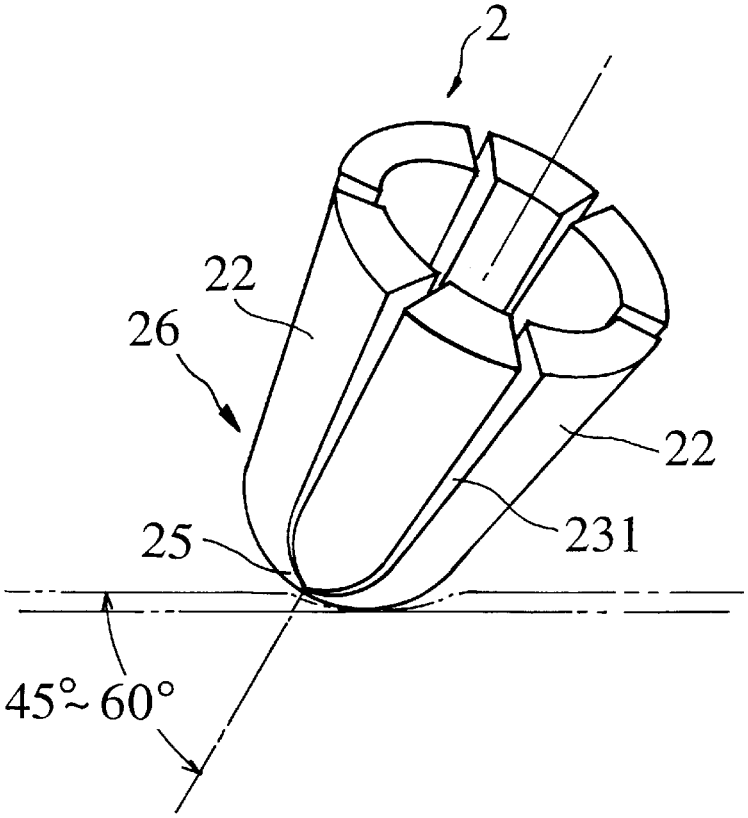
Figure 8:
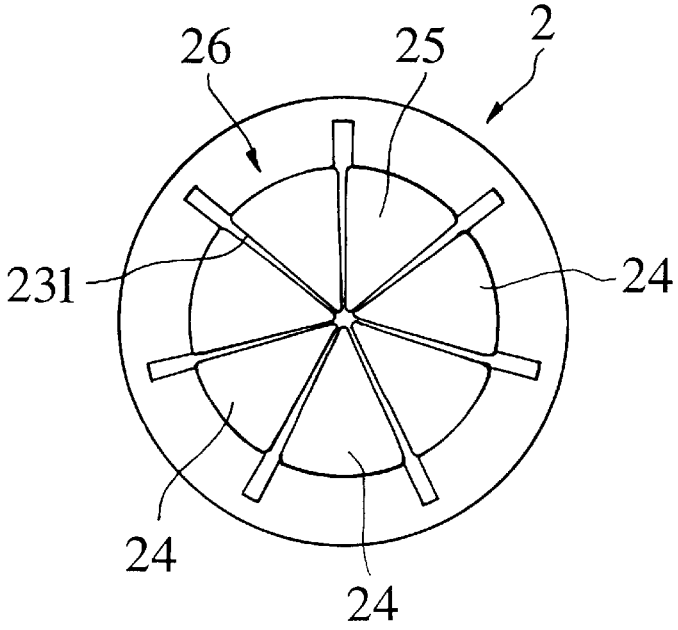
Figure 9A:
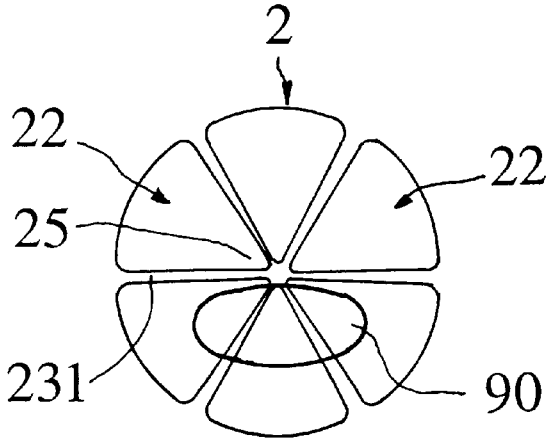
Figure 9B:
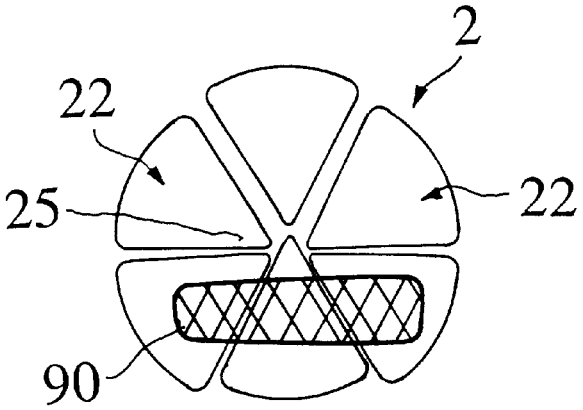
Figure 9C:
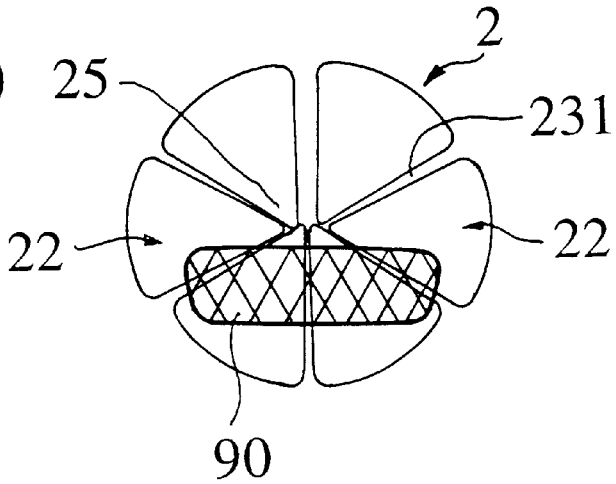
Figure 10A:
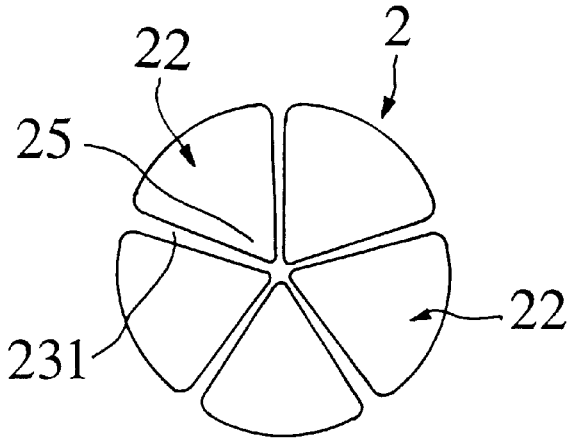
Figure 10B:
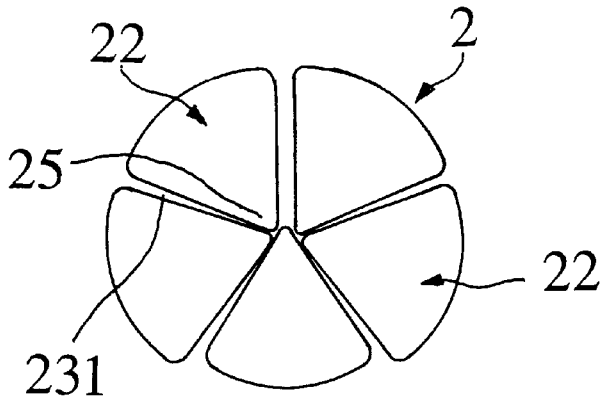
Figure 10C:
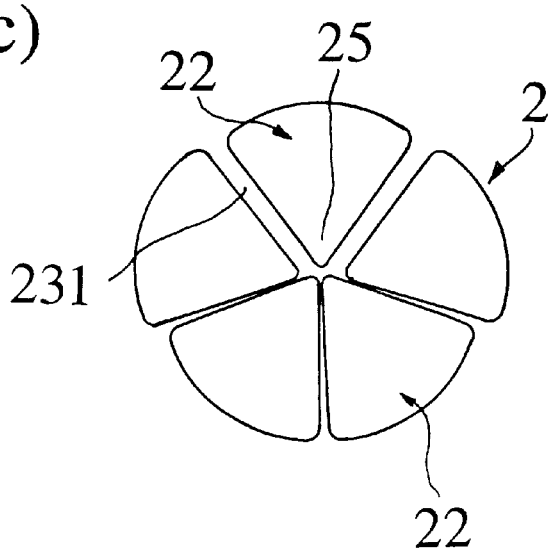

FIGS. 3(*a*) and 3(*b*) are cross sections of a die used in the process of manufacturing the penpoint of the embodiment and cross sections of a molded product;

FIG. 4 is an enlarged perspective view of a writing tip of the penpoint of the embodiment;

FIG. 5 is a cross section of the writing tip of the penpoint of the embodiment;

FIG. 6 is a side cross section of a writing material using the penpoint of the embodiment;

FIG. 7 is a perspective view showing a part of the penpoint of the embodiment in use, with the writing tip in contact with the paper;

FIG. 8 is a front-end view of a variation of the embodiment showing the writing tip of the penpoint having a different number of comb-tooth pieces;

FIGS. 9(*a*), 9(*b*), and 9(*c*) are front-end views showing how the writing tip of the penpoint of the embodiment works; and FIGS. 10(*a*), 10(*b*), and 10(*c*) are front-end views of the writing tip of the penpoint of the embodiment having a different number of comb-tooth pieces, showing how the writing tip works.

DESCRIPTION OF THE PREFERRED EMBODIMENTS

Figure 1:
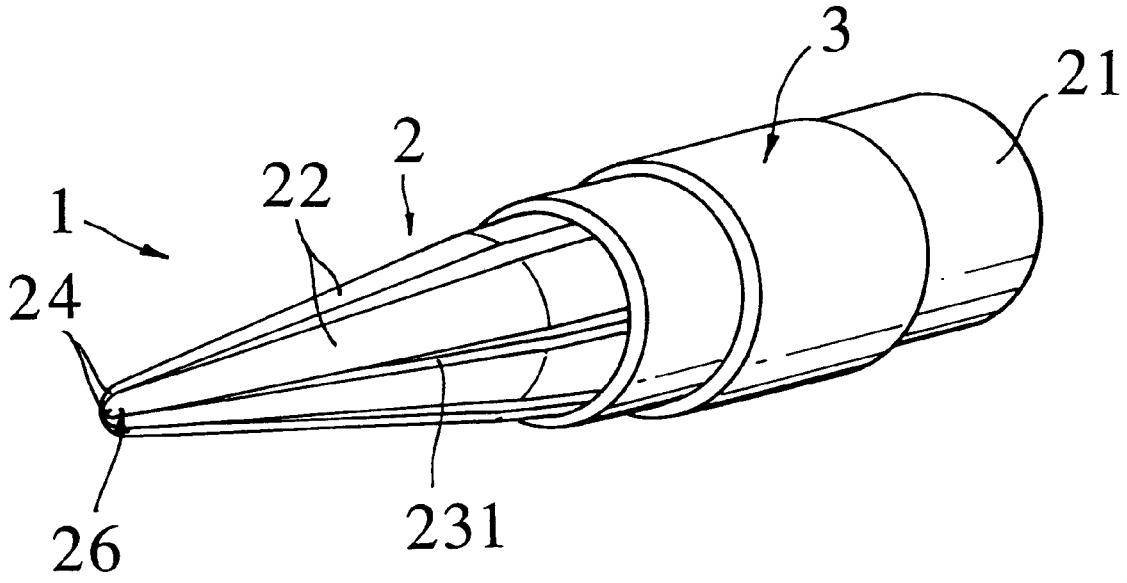
FIG. 1 is an overall perspective view of a penpoint as one embodiment of this invention.

FIG. 1 shows an overall configuration of the penpoint of one embodiment of this invention. In FIG. 1, reference number 1 represents a penpoint, which comprises a resin-molded penpoint body 2 having a certain writing pressure and a converging member 3.

Figure 2:
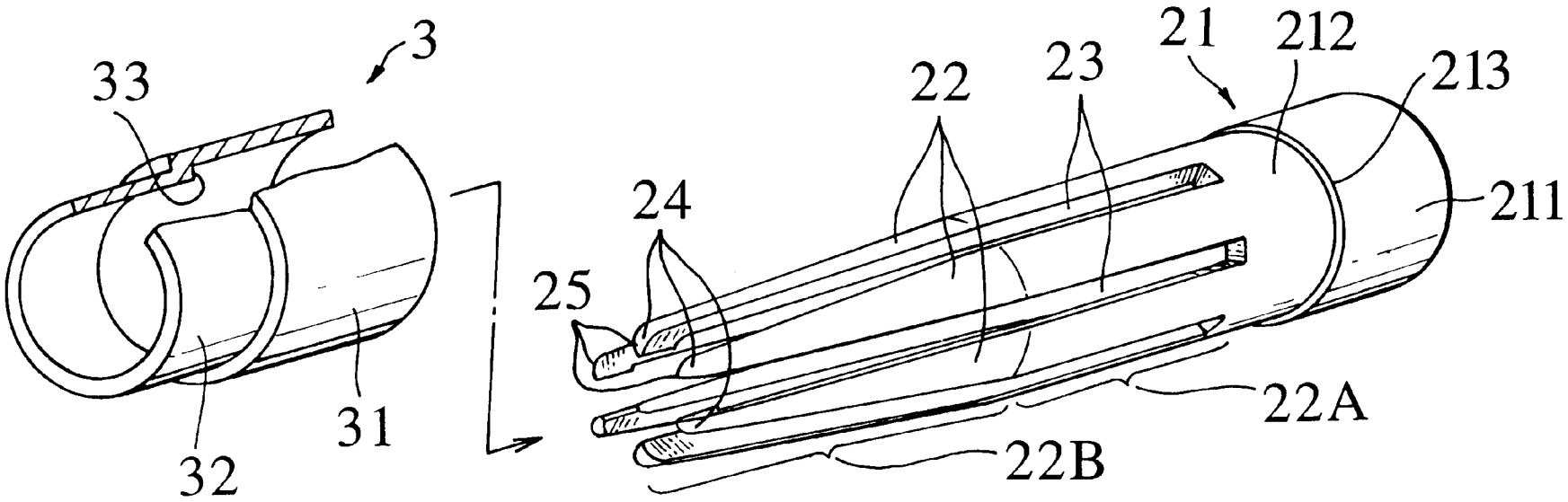
FIG. 2 is an exploded perspective view of the penpoint of the embodiment.
Figure 3A:
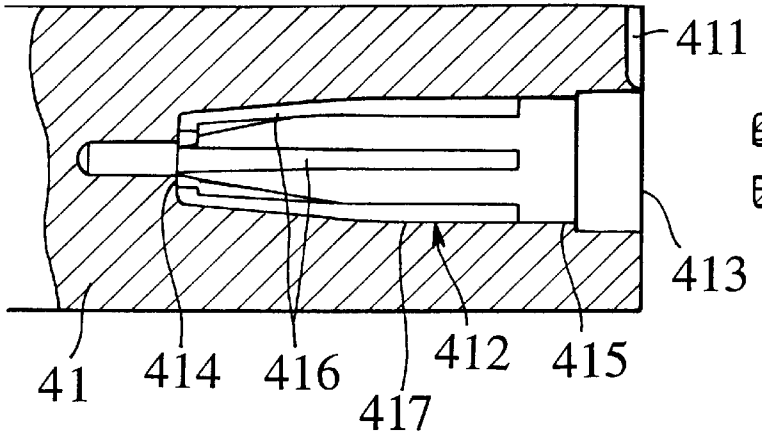
Figure 3B:
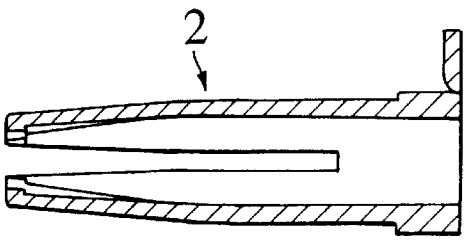
Figure 3C:
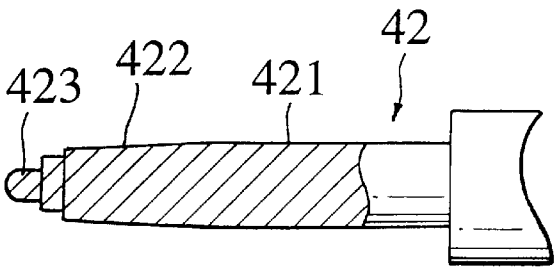
Figure 3E:
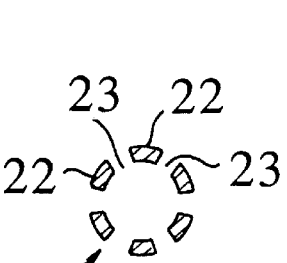
Figure 3D:
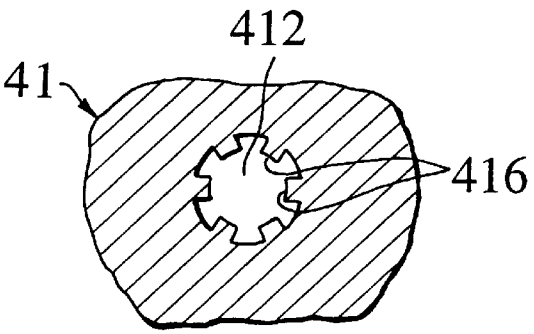

The penpoint body 2 is formed of synthetic resin as one piece by the injection molding and, as shown in FIG. 2, includes a cylindrical base portion 21 and a plurality of comb-tooth pieces 22 projecting from one end of the base portion 21. These comb-tooth pieces 22 are arranged at equal intervals along the circumference about the axis of the penpoint body 2 to form slit-like grooves 23 between the comb-tooth pieces 22. In this embodiment the penpoint body 2 has 5 to 8 comb-tooth pieces 22.

The base portion 21 has a base large-diameter portion 211 and a base small-diameter portion 212 with a base stepped portion 213 therebetween. The comb-tooth pieces 22 extend in arc in lateral cross section continuously along the circumference of one end of the base small-diameter portion 212 of the base portion 21. Each of the comb-tooth pieces 22 gradually tapers off from the base portion 21 toward the front end, with a base portion-side half 22A projecting almost linearly parallel along the axis of the penpoint body 2 and with a front end-side half 22B inclining progressively inwardly toward the front end to form a beak-like shape. Hence, the comb-tooth pieces 22, until they reach and merge with the cylindrical base portion 21, are inwardly curved triangular plates in longitudinal cross section that together form a longitudinally divided cone. In other words, the comb-tooth pieces 22 are triangular cantilevers fixed at one end with a boundary portion of the base portion 21. The comb-tooth pieces 22, when pressed as a whole from the circumferential outside toward the axis, are compressed inwardly into an almost cylindrical shape and at the same time the front end-side half 22B is compressed into a conical shape. The comb-tooth pieces 22 each constitute the individual cantilever pieces forming the longitudinally divided cone. The comb-tooth pieces 22 are each provided at their front end with divided hemisphere portions 24 that together form a hemisphere tip of the penpoint, with their outer corners rounded.

Now, the process of making the penpoint body 2 is briefly explained by referring to FIGS. 3(*a*)–3(*e*). FIGS. 3(*a*)–(*c*) shows a die and the penpoint body 2 injection-molded from this die and taken out of it. FIGS. 3(*d*)–3(*e*) shows a cross section of a cavity block used for a female die and a cross section of a molded product made by the die.

In FIG. 3 (*a*)–3(*c*), reference numeral 41 represents a cavity block which serves as a female die, and 42 a core pin installed in the cavity block 41 to serve as a male die. The cavity block 41 and the core pin 42 together form the molding die. The cavity block 41 has a resin supply port 411, through which a hot molten synthetic resin is poured from outside the die, and a cavity 412 into which the synthetic resin is supplied. The cavity 412 is a hollow portion formed to match the external shape of the penpoint body 2 to be fabricated. It consists of a base forming portion 415 and a comb teeth forming portion 417. The base forming portion 415 is a cylindrical space having a stepped structure, whose geometry corresponds to the external shape of the base portion 21 of the penpoint body 2. The comb teeth forming portion 417 is a cylindrical and conical continuous space that merges with the base forming portion 415 and whose geometry corresponds to the external shapes of the base portion-side half 22A and front end-side half 22B of the comb-tooth pieces 22 of the penpoint body 2. The comb teeth forming portion 417 has a plurality of fin-like projections 416 arranged at equal intervals along the entire inner circumferential surface thereof and projecting toward the axis. The core pin 42 is formed to match the internal shape of the penpoint body 2 to be fabricated and consists of a cylindrical portion 421 corresponding to the base portion 21 and the base portion-side half 22A of the comb-tooth pieces 22 of the penpoint body 2, a conical portion 422 corresponding to the front end-side half 22B of the comb-tooth pieces 22, and a hemispheric portion 423 projecting forwardly from the front end.

The dies of such constructions are used to injection-mold the above-mentioned penpoint body 2. The fin-like projections 416 in the hollow space of the cavity 412 shown in FIG. 3(*d*)–3(*e*) cause a plurality of slit-like grooves 23 to be formed in the molded product, with the comb-tooth pieces 22 on either side of the grooves 23.

In this penpoint body 2, because the comb-tooth pieces 22 are not constricted together into a near conical shape, with the front end side left relatively wide open, the gaps between the comb-tooth pieces 22 are not narrowed, facilitating the manufacture of the die for the penpoint body 2. Further, because the gaps between the divided hemisphere portions 24 at the tip of the comb-tooth pieces 22 are maintained by the slit-like grooves 23, it is possible to provide the fin-like projections 416 of the cavity 412, in particular, with sufficient thickness and width dimensions to withstand the injection pressure during the injection molding and to give improved strength to the die.

Further, because the divided hemisphere portions 24 at the tip of the comb-tooth pieces 22 are open immediately after the injection molding, the outer corners of the divided hemisphere portions 24 are subjected to polishing such as blast, barrel and buff to smooth a crown portion 25. This eliminates the edges of the divided hemisphere portions 24—which, when bound together, form into a hemispheric writing tip—to prevent the crown portion from catching the paper and ensure smooth movement during writing.

Referring to FIG. 2, the converging member 3 is formed as a cylinder, which can be fitted over the intermediate portion of the penpoint body 2 to press the comb-tooth pieces 22 closer together toward the axis of the penpoint body 2 so that they form a conical inner circumferential structure whose diameter progressively decreases toward the front end. The converging member 3 shown in FIGS. 1 and 2 is made of a metallic pipe and has a large-diameter portion 31 almost equal in diameter to, and able to be fitted over, the base large-diameter portion 211 of the penpoint body 2; a small-diameter portion 32 which is fitted over a part of the penpoint body 2 ranging from the base small-diameter portion 212 of the penpoint body 2 to the base portion-side half 22A of the comb-tooth pieces 22 and is so sized in inner diameter as to press the comb-tooth pieces 22 to converge together; and a stepped portion 33 at the boundary between the large- and small-diameter portions. This converging member 3, as shown in FIG. 6, can be formed directly on a mouth piece that mounts the penpoint 1 to the body portion 51 of the pen shaft. This converging member 3 or mouth piece 3 is formed as one piece of synthetic resin, and has a large-diameter portion 301 almost equal in inner diameter to the base large-diameter portion 211 of the penpoint body 2, a medium-diameter portion 302 almost equal in inner diameter to the base small-diameter portion 212 of the penpoint body 2, a small-diameter portion 303 so sized in inner diameter as to press the front end-side half 22B of the comb-tooth pieces 22 of the penpoint body 2 to converge into a conical shape, and a stepped portion 304 between the large-diameter portion 301 and the medium-diameter portion 302.

The penpoint 1 has the penpoint body 2 and the converging member 3 of the above construction as its constitutional elements. The converging member 3 is fitted over the penpoint body 2 from the front end and is slid until the stepped portion 33 or 304 of the converging member 3 between the large-diameter portion 31 or 301 and the small-diameter portion 32 or medium-diameter portion 302 abuts against the base stepped portion 213 of the penpoint body 2. In this manner, the large-diameter portion 31 or 301 of the converging member 3 is securely fitted over the base large-diameter portion 211 of the penpoint body 2 under pressure, with the small-diameter portion 32 pushing the comb-tooth pieces 22 from outside toward the axis of the penpoint body 2 with uniform pressure to cause the base portion-side half 22A to converge into an undistorted cylindrical shape and the front end-side half 22B to converge into an undistorted conical shape whose diameter progressively decreases. Hence, the adjoining comb-tooth pieces 22 are brought into resilient contact with each other and, as shown in FIGS. 4 and 5, the divided hemisphere portions 24 at the tip of the penpoint body 2 are bound together to form a smooth hemispheric writing portion 26. The crown portion 25 is formed of a plurality of tips of the comb-tooth pieces 22 bound in circle like petals in cross section, with the outer circumferential portion forming a writing portion that is pressed against the paper during writing. At interface portions between the facing sides of the adjoining comb-tooth pieces 22, there are formed ink introducing passages 231 which function as capillary tubes.

FIG. 6 shows the construction of the writing tool 5 having the penpoint 1. In this example, the converging member 3 is formed in the mouth piece, as described earlier, to facilitate the mounting of the penpoint 1 onto the pen shaft. In FIG. 6, reference number 51 represents a body portion of the pen shaft, which contains an ink reservoir cotton 52 as an ink reservoir. Denoted 53 is an ink introducing core. Designated 54 is a pen retainer formed of a tube body that can hold the ink introducing core 53 and which consists of, from the front end toward the base, a small-diameter portion 541, a medium-diameter portion 542 and a large-diameter portion 543. The ink introducing core 53 is inserted into the hollow space of the penpoint body 2 until it reaches the front end of the penpoint body 2, and then held and fixed by the pen retainer 54. With the ink introducing core 53 inserted therethrough, the pen retainer 54 has its medium-diameter portion 542 inserted under pressure into the base portion 21 of the penpoint body 2 and its large-diameter portion 543 inserted under pressure into the base-end side opening of the mouth piece 3, and is thus fixed inside the penpoint body 2 and the mouth piece 3. As a result, the penpoint body 2, mouth piece 3, ink introducing core 53 and pen retainer 54 are assembled together. In this way, the penpoint body 2 is forced into the inside of the front end part of the body portion 51 of the pen shaft while being kept in its conical shape by the mouth piece 3. The ink introducing core 53 is inserted into the ink reservoir cotton 52, so that ink is supplied from the ink reservoir cotton 52 through the ink introducing core 53 to the inner surface of the penpoint body 2, from which it is further fed through the ink introducing passages 231 to the outer side of the hemispheric writing portion 26.

Next, the writing operation of the writing tool 5 using the penpoint 1 will be explained by referring to FIG. 7 to FIG. 10. In this penpoint 1, the comb-tooth pieces 22 are divided pieces that, when bound together, form into a cone and which have separate tips. That is, the comb-tooth pieces 22 each have a separate tip so shaped that these tips, when bound together, form a hemisphere. When viewed in longitudinal cross section, the comb-tooth pieces 22, until they merge with the cylindrical base portion 21, are separate, curved triangular cantilever plates fixed at the base portion 21 boundary which together form into a cone when combined. Thus, when the writing tool 5 is in use and the writing pressure is applied to the penpoint 1, a lifting force (deflecting force) acts on the tips of the comb-tooth pieces 22, causing the comb-tooth pieces 22 to deflect and deform with the portion fixed by the converging member 3 working as a fulcrum. When this lifting force is eliminated, the comb-tooth pieces 22 recover their original shape.

The crown portion 25 of the penpoint 1, which forms the hemispheric writing portion 26 and is comprised of the tips of the comb-tooth pieces 22 combined together in the form of a cone, is shown three-dimensionally in FIGS. 7 and 8 or in FIGS. 9(*a*) and 10(*a*). FIG. 7 is a partial perspective view showing the crown portion 25 of the penpoint 1—whose conical portion is formed of six comb-tooth pieces 22—put in contact with paper. FIG. 8 is a front-end view of the crown portion 25 of the penpoint 1 whose conical portion is formed of seven comb-tooth pieces 22. The crown portion 25 of the penpoint 1 looks like an orange peeled off and seen from the calyx side with each piece of fruit representing the front end shape of each comb-tooth piece 22.

When the writing tool 5 is used with the penpoint 1 placed in contact with the paper and tilted at an angle of 45° to 60°, the ink that has reached the gaps in the crown portion 25 in contact with the paper or the front inner side of the ink introducing passages 231 on the underside oozes out onto the paper by the capillary tube phenomenon at the interface between the paper and the crown portion 25, thus allowing the lines to be written. The elastic deformation of the hemispheric writing portion 26 caused by the writing pressure is shown in FIGS. 9(*a*)–9(*c*) and FIGS. 10(*a*)–10(*c*).

FIGS. 9(*a*), 9(*b*), and 9(*c*) are front-end views showing changes in shape, during the writing operation, of the writing portion 26 of the penpoint 1 whose conical portion is formed of six comb-tooth pieces 22. FIG. 10 shows the similar changes in shape of the writing portion 26 of the penpoint 1 whose conical portion is composed of five comb-tooth pieces 22. In FIG. 9, (*a*) represents the state of the front end of the penpoint 1 when the pen is oriented with respect to the paper so that one of the comb-tooth pieces 22 is located truly at the bottom or the lowest position but the crown portion 25 of the penpoint 1 is out of contact with the paper or in light contact but with no pressure applied. In this condition, no deflection force acts on any of the comb-tooth pieces 22, which are thus in elastic contact with each other. Next, when a person applies a force to write characters, the writing pressure causes the crown portion or tip 25 at the end of the comb-tooth pieces 22 to deflect upward about a fulcrum, the portion of the penpoint body 2 fixed by the mouth piece 3 on the base portion 21. Because of the resistance produced by the rigidity of the material of the comb-tooth pieces 22, the displacement of the front end portion is limited to a specified amount, for example, 0.1–0.5 millimeters (mm) during the normal writing. When the hemispheric crown portion 25 is viewed from the front, the bottom one of the comb-tooth pieces 22, which make up the crown portion 25, is pushed up, as shown in FIG. 9(*b*), lifting the opposing top comb-tooth piece 22 and pushing the left and right comb-tooth pieces 22 laterally outwardly. As a result, the overall shape of the crown portion 25 and therefore the writing portion 26 deforms from the hemispheric shape.

As a result, the overall diameter of the hemispheric portion and its area contacting the paper increase. In other words, an shaded area 90 of the penpoint that contacts the paper increases. The degree of this increase in the contact area becomes large as the writing pressure—the pressure to press the penpoint 1 against the paper—increases. The thickness of a line being drawn depends on the outer diameter of the crown portion 25 and increases as its hemispheric shape expands. That is, the line thickness varies according to the magnitude of the writing pressure. Further, because the entire comb-tooth pieces 22 deflect according to the writing pressure, the comb-tooth pieces 22 as a whole work as a cushion to absorb some of the writing pressure when it is large.

Unlike the penpoint states of FIGS. 9(*a*) and 9(*b*), FIG. 9(*c*) shows the deformed state of the crown portion 25 when the pen is oriented with respect to the paper in such a way that one of ink introducing passages 231 between the two comb-tooth pieces 22 at the front end of the penpoint 1 is located truly at the bottom and when the crown portion 25 of the penpoint 1 is applied a pressure. In this case, when the hemispheric writing portion 26 is viewed from the front, the writing pressure causes the front end portion of the two bottom comb-tooth pieces 22 to move up, pushing other comb-tooth pieces 22 to expand laterally, thus elastically deforming the hemispheric crown portion 25. Other workings and behaviors are similar to those of FIGS. 9(*a*) and 9(*b*). In writing conditions other than FIGS. 9(*a*), 9(*b*) and 9(*c*), i.e., when the pen is rotated about the pen axis to assume any other rotary position than those of FIGS. 9(*a*), (*b*) and (*c*), the similar working and behavior to those mentioned above can be obtained with the writing portion 26 elastically deformed to slightly expand its diameter, as long as the crown portion 25 of the penpoint 1 is placed in contact with the paper with the pen axis inclined.

In the penpoint of FIG. 10, too, deformations similar to those described by referring to FIG. 9 result during the writing operation. FIG. 10 (*a*) represents the state of the crown portion 25 at the front end of the penpoint 1 when the pen is so oriented with respect to the paper that one of the comb-tooth pieces 22 in situated directly at the bottom, with the crown portion 25 of the penpoint 1 out of contact with the paper or in contact but without a writing pressure. In this state, no deflecting force is applied to any of the comb-tooth pieces 22, which therefore are in elastic contact with each other. Next, when a user applies a force to the penpoint, the writing pressure deflects and moves up the crown portion 25, the front end of the comb-tooth pieces 22 secured at the base portion 21 of the penpoint body 2. The displacement of the crown portion 25 is about 0.1 to 0.5 mm as in the case of FIGS. 9(*a*) to 9(*c*) when the writing pressure is normal. Because the conical portion of the penpoint 1 is composed of five comb-tooth pieces 22, as can be seen from the front view of the hemispheric writing portion 26, as the front end of the bottom comb-tooth piece 22 is moved up, it pushes the left and right comb-tooth pieces 22 laterally outwardly, thus deforming the hemispheric shape as shown in FIG. 10(*b*).

FIG. 10(*c*), unlike FIGS. 10(*a*) and 10(*b*), represents the deformed state of the crown portion 25 when the pen is oriented with respect to the paper in such a way that one of ink introducing passages 231 between the two comb-tooth pieces 22 at the front end of the penpoint 1 is located truly at the bottom and when the crown portion 25 of the penpoint 1 is applied a pressure. In this case, as can be seen from the front view of the hemispheric crown portion 25, the writing pressure moves up the front end portion of the two bottom comb-tooth pieces 22, which then combine to lift the opposite top comb-tooth piece 22 and push the left and right comb-tooth pieces 22 laterally outwardly, thus elastically deforming the hemispheric crown portion 25. Other workings and behaviors are similar to what has been described earlier. Although FIG. 10 does not show the paper-contacting area 90 shown shaded in FIG. 9, the similar paper-contacting area 90 is also produced in the case of FIG. 10.

In the above embodiments, therefore, the penpoint body 2 is resin-molded to a specified thickness and has a base portion 21 and five to eight comb-tooth pieces 22. The penpoint body 2 is assembled into a simple structure in which a converging member 3 made of a metal pipe or resin mouth piece is fitted over the portion between the base portion 21 and the comb-tooth pieces 22. The uniform pressure of the converging member 3 forces the five to eight comb-tooth pieces 22 to converge toward one another forming into an undistorted cone, with the front ends of these comb-tooth pieces 22 bound together to form an undistorted hemispheric writing portion 26 and with ink introducing passages 231 formed between the adjoining comb-tooth pieces 22.

When the hemispheric writing portion 26 of the penpoint 1 of the above construction is placed in contact with the paper with its axis inclined to the paper, the divided hemisphere portions 24 at the front end of the comb-tooth pieces 22 shift relative to one another elastically deforming to expand the outer diameter of the hemispheric portion. When the penpoint 1 is relieved of the writing pressure, the front end portion returns to the original hemispheric shape by elasticity. This elastic deformation and recovery not only allows the penpoint to write on paper in any direction and, after the penpoint is rotated about a pen axis, to also write at any rotated position and at any angle with respect to the paper, but also provides the penpoint with a writing brush capability by which the penpoint can change the thickness of strokes according to the writing pressure applied, realizing a variety of modes of handwriting. Further, the cushion made by the comb-tooth pieces 22 deflecting according to the magnitude of the writing pressure to absorb some of the pressure gives the writer's hand a feel of soft pen touch, thus alleviating the fatigue that he or she will otherwise feel after many hours of writing. This cushion also alleviates deformation and wear of the penpoint when the writing pressure is large and thus improves durability of the writing portion. Another advantage is that if the pen is not used for many hours or ink is dried clogging the fine gaps in the front end of the penpoint 1, the writing operation deforms the hemispheric writing portion 26 and therefore the fine clearances, breaking the dry clogging ink film or lump to easily introduce the ink outwardly.

In the above embodiments, because the penpoint body 2 is injection-molded as a one-piece structure, there is no variation in the dimensional and positional accuracy in the manufacture process, realizing a mass production with high yields. In the manufacture process, there is no need for cutting or grinding work or heavy polishing work to remove the cut traces, but what is needed is light polishing, such as blast or barrel processing, to smoothly finish the surface of the penpoint body 2, allowing the manufacture of large quantities at low cost.

When the conical portion of the penpoint is composed of four or less comb-tooth pieces 22, instead of five to eight, to reduce the number of divided pieces of the hemispheric writing portion 26, the interval of the ink introducing grooves 23 at the interfaces between the adjoining comb-tooth pieces 22 becomes large compared with the outer diameter of the front end portion. Hence, when the penpoint 1 contacts the paper, the distance from the paper to the ink introducing groove may, depending on the angle, become large preventing smooth supply of ink onto the paper through capillary tube action. In this case, the angle of penpoint with respect to the paper needs to be limited to a certain extent. Although one of the objects of this invention is to allow smooth and free writing in any direction in as wide a range of angle between the penpoint and the paper as possible, for instance, at an angle of 90° to 45°, if this range of angle is slightly restricted, the number of divided pieces of the conical portion of the penpoint can be reduced to four, three or even two or less while maintaining the similar working and effect as long as the penpoint is made in a similar construction so that the hemispheric writing portion deform and expands when subjected to the writing pressure.

Although these embodiments have described the penpoint body 2 to be formed of a resin material by injection molding, it may be made by punching a metal plate by a press and forming or rounding it. It can also be formed by sintering metallic powder or by forming or firing ceramic powder. In either case, the front ends of the comb-tooth pieces 22 are open and separated from one another, which allows efficient polishing of the front end hemispheric portion, as by buff, barrel and blast, thus facilitating the manufacture of the smooth writing portion 26. Further, because the comb-tooth pieces 22 are combined together into a conical shape by the converging member 3 that applies a uniform pressure to the circumference of the comb-tooth pieces 22, it is possible to easily form an undistorted conical penpoint, whether it is made of metal or ceramics.

What is claimed is:

1. A conical penpoint for writing on paper comprising:

a penpoint body comprising:

a cylindrical base portion; and a hollow conical portion having an axis and being disposed on a front-end side of the cylindrical base portion, the hollow conical portion extending forwardly from a longitudinally intermediate part of the penpoint body to a semispherical apex while progressively reducing its diameter, the hollow conical portion including a plurality of fine slits formed therein at equal intervals about the axis and extending from the semispherical apex toward the rear along planes containing the axis of the conical portion to divide the conical portion into a plurality of comb-tooth pieces, the comb-tooth pieces having base-end sides thereof merging with the cylindrical base portion; and an ink feed means disposed inside the penpoint body and reaching an inner surface of the front end of the conical portion of the pen-point body;

wherein the comb-tooth pieces are pressed to bend inwardly, curved in arc with respect to their center lines, and are pressed together at the front end to form the semispherical apex where the adjacent comb-tooth pieces are in resilient contact with each other, and further, said comb-tooth pieces are bent inwardly at the base-end sides such that inwardly curved sides of said comb-tooth pieces are facing inside;

wherein, the comb-tooth pieces are joined together at the front end to form the semispherical apex portion where tips of the adjacent comb-tooth pieces are in resilient contact with each other; and wherein, when the semispherical apex formed of the tips of the comb-tooth pieces is pressed against paper with the axis at an angle to the paper, the tips of the comb-tooth pieces move relative to each other to elastically deform the semispherical apex and expand an outer diameter thereof, and when the semispherical apex is relieved of the pressing force, the tips of the comb-tooth pieces return to original relative positions thereof by elasticity and recover an original semispherical shape of the apex;

wherein, the tips of the comb-tooth pieces elastically move relative to each other when the semispherical apex is pressed against the paper at the angle with a normal writing pressure resulting from a normal user force applied to the penpoint when writing;

a converging member formed as a cylinder and fitted over an outer circumference of the penpoint body to press the plurality of the comb-tooth pieces to converge toward the axis of the penpoint body;

wherein the converging member is fitted over the penpoint body to force the plurality of the comb-tooth pieces of the penpoint body to converge into a conical shape whose diameter progressively decreases toward the front end, and in this bound state of the comb-tooth pieces a hemispheric writing portion is formed at the front ends of the comb-tooth pieces and ink introducing passages are formed between the comb-tooth pieces.

2. A conical penpoint according to claim 1, wherein the number of comb-tooth pieces of the penpoint body is set to five to eight.

3. A conical penpoint according to claim 1, wherein the penpoint body is made of a resin material and formed as one piece by an injection molding.

4. A conical penpoint according to claim 1, wherein the penpoint body is made by punching, forming and rounding a metal material.

5. A conical penpoint according to claim 1, wherein the front ends of the comb-tooth pieces that together form the hemispheric writing portion have all external corners rounded.

6. A conical penpoint according to claim 1, wherein the converging member is formed of a metal pipe.

7. A conical penpoint according to claim 1, wherein the converging member is formed of a mouth piece that is used to mount the penpoint to a pen shaft.

8. A conical penpoint according to claim 2, wherein the penpoint body is made of a resin material and formed as one piece by an injection molding.

9. A conical penpoint according to claim 8, wherein the front ends of the comb-tooth pieces that together form the hemispheric writing portion have all external corners rounded.

10. A conical penpoint according to claim 9, wherein the converging member is formed of a metal pipe.

11. A conical penpoint according to claim 9, wherein the converging member is formed of a mouth piece that is used to mount the penpoint to a pen shaft.

12. A conical penpoint according to claim 2, wherein the penpoint body is made by punching, forming and rounding a metal material.

13. A conical penpoint according to claim 12, wherein the front ends of the comb-tooth pieces that together form the hemispheric writing portion have all external corners rounded.

14. A conical penpoint according to claim 13, wherein the converging member is formed of a metal pipe.

15. A conical penpoint according to claim 13, wherein the converging member is formed of a mouth piece that is used to mount the penpoint to a pen shaft.

16. A conical penpoint according to claim 2, wherein the front ends of the comb-tooth pieces that together form the hemispheric writing portion have all external corners rounded.

17. A conical penpoint according to claim 16, wherein the converging member is formed of a metal pipe.

18. A conical penpoint according to claim 16, wherein the converging member is formed of a mouth piece that is used to mount the penpoint to a pen shaft.

19. A conical penpoint according to claim 3, wherein the front ends of the comb-tooth pieces that together form the hemispheric writing portion have all external corners rounded.

20. A conical penpoint according to claim 4, wherein the front ends of the comb-tooth pieces that together form the hemispheric writing portion have all external corners rounded.

* * * * *